United States Patent [19]

Martin

[11] 4,406,298

[45] Sep. 27, 1983

[54] APPARATUS FOR CLEANING DYE BOTTLES OR SIMILAR ARTICLES

[76] Inventor: Jack Martin, 434 Rahway Ave., Woodbridge, N.J. 07095

[21] Appl. No.: 330,214

[22] Filed: Dec. 14, 1981

[51] Int. Cl.[3] ..... B08B 9/08

[52] U.S. Cl. ..... 134/167 R; 134/171

[58] Field of Search ..... 134/166 R, 167 R, 168 R, 134/171-172, 198-199, 22.1

[56] References Cited

U.S. PATENT DOCUMENTS

| | | | |
|---|---|---|---|
| 473,947 | 5/1892 | Murphey | 134/166 R |
| 2,222,676 | 11/1940 | Mahler | 134/171 |
| 2,435,807 | 2/1948 | Udell | 134/198 X |
| 2,600,638 | 6/1952 | Gollong | 134/198 X |
| 3,448,743 | 6/1969 | Berry | 134/171 X |

FOREIGN PATENT DOCUMENTS

| | | | |
|---|---|---|---|
| 641694 | 2/1937 | Fed. Rep. of Germany | 134/166 R |
| 856449 | 12/1960 | United Kingdom | 134/166 R |

*Primary Examiner*—Robert L. Bleutge

*Attorney, Agent, or Firm*—Arthur L. Plevy

[57] ABSTRACT

An apparatus for cleaning dye bottles uses an elongated tubular member having a first inlet end adapted to be coupled to a source of water and having an outlet end for discharging water. On the surface of the tubular member are groups of apertures with each group spaced a predetermined distance apart. The groups of apertures are surrounded by a coupling member having an inner threaded section for engaging the threaded neck of a bottle. In using the device a separate bottle is retained within each coupling member and water is directed to the inlet end and discharged from the outlet end. The apertures in the tubular member allow water to enter each bottle and to clean the same during operation.

10 Claims, 7 Drawing Figures

APPARATUS FOR CLEANING DYE BOTTLES OR SIMILAR ARTICLES

BACKGROUND OF INVENTION

This invention relates to a new and improved apparatus for washing bottles and more particularly for washing dye bottles as used in a beauty salon or similar establishment.

The prior art discloses a number of patents which depict and show apparatus used to wash or clean the interior of a bottle. In regard to such apparatus there are many different ways of accomplishing the end result.

U.S. Pat. No. 723,792 entitled BOTTLE RINSING APPARATUS issued on Mar. 24, 1903 to D. Wickham. This patent shows a device for washing a bottle where the bottle is placed in a holder. The holder has a nozzle spaced at a distance from the opening of the bottle.

U.S. Pat. No. 640,111 entitled BOTTLE WASHER issued on Dec. 26, 1899 to H. E. Decker. This patent shows a machine for washing bottles. The apparatus uses a series of wipers which are inserted through the opening of the bottle and which are adgitated to wipe the insides of the bottle for cleaning.

As can be seen from the above two patents, these early devices are relatively complicated but serve the purpose of rinsing or washing the bottle. More recent apparatus such as U.S. Pat. No. 1,669,492 entilted BOTTLE WASHER and issued on Dec. 15, 1928 to P. W. Shields show bottle washers where the bottles are held in an inverted position. A nozzle directs fluid inside the bottle as the bottle is moved on a conveyor belt and serves to wash the inside of the bottle at various angles.

Other patents as U.S. Pat. Nos. 2,129,944 and 2,227,734 show techniques for washing bottles which techniques employ flexible tubes or other devices which are inserted into the opening of the bottle for cleaning the same. Still other patents such as U.S. Pat. Nos. 2,435,807 and 2,647,526 depict complicated machinery for washing and sterilizing various bottle configurations for many different purposes.

As one can seen from the above noted patents, the art of washing bottles has been developed over a rather extensive period of time and many different techniques and apparatus are shown. In any event, there is a need for a simple apparatus which will wash or clean bottles in a particular environment. For example, in modern day beauty salons extensive use is made of hair dye. The dye is mixed by the operator in a dye bottle and when the proper color is obtained, the dye is placed upon a customer's hair as is well-known. In any event, a typical establishment uses many dye bottles during the course of the day. These bottles are extremely useful and must be washed to remove any dye from the bottle before they can be used again. The task of washing these bottles is extremely time consuming and a rather unpleasant chore for the employees of such an establishment.

It is therefore an object of the present invention to provide an economical and simple apparatus particularly adaptable for automatically washing or cleaning dye bottles as used in a beauty salon. It is of course understood that the apparatus may be used to wash or clean any bottle which is used for mixing or handling materials that are not ingested by a consumer.

BRIEF DESCRIPTION OF THE PREFERRED EMBODIMENT

An apparatus for cleaning bottles employs an elongated tubular member having an inlet opening at one end and an outlet at the other end. The surface of the tubular member has a plurality of groups of apertures spaced apart at predetermined intervals. Each group of apertures is surrounded by a coupling member which has a thread accomodating opening to accomodate a bottle emplaced therein. When fluid is introduced into the inlet openings and each coupling member is accomodating a bottle, the fluid enters the bottles through the groups of apertures and cleans the internal hollow of the bottle. The dirty fluid is automatically discharged via the outlet opening.

DETAILED DESCRIPTION OF THE FIGURES

Figure 1:
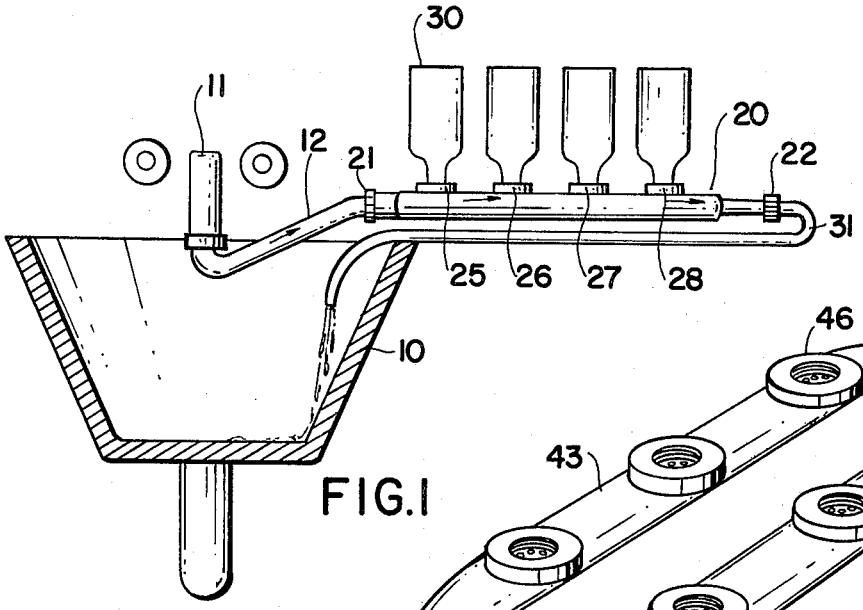
FIG. 1 is a plan view depicting an apparatus for cleaning bottles according to this invention.

Referring to FIG. 1, there is shown a plan view of a dye bottle cleaning apparatus according to this invention. A typical sink 10 is depicted in a conventional manner. The sink 10 has a faucet 11 from which hot or cold water can be obtained. Shown coupled to the faucet is a flexible hose section 12 which is coupled to a bottle washing apparatus 20 according to this invention. The apparatus 20 consists of a plastic or other type of pipe having an inlet opening 21 and an outlet opening 22. The pipe has a plurality of apertures located on a surface and arranged in specific groups and therefore spaced apart at predetermined intervals according to the width of the bottle to be accomodated. Each group of apertures is surrounded by a separate annular member as 25 to 28. Each annular member has an internal threaded aperture which is selected to accomodate the threaded neck of a dye bottle.

As seen in FIG. 1, the washing section 20 is accomodating four bottles as 30. Each bottle is screwed into the threaded aperture of the associated annular member as 25 to 28. Each annular member surrounds and is associated with a group of apertures in the pipe. As seen in FIG. 1, the apertures allow water to enter the bottles as 30 and to therefore clean the bottles. The outlet 22 of the apparatus is coupled via a tube 31 back into the sink where dirty water is discharged via the drain. As noted, the outlet of the apparatus may be of a narrower diameter or constricted as compared to the inlet opening or inlet section of the apparatus 20. In this manner the apparatus will assure that a sufficient pressure is developed to enable the rapid washing of each of the bottles. As shown in FIG. 1, the bottles 30 are maintained in an inverted position but the apparatus can be operated with the bottles facing downwardly as well.

Although four bottles are shown in FIG. 1, it is understood that more or less bottles can be accomodated as the apparatus is extremely simple to construct and use.

Figure 2:
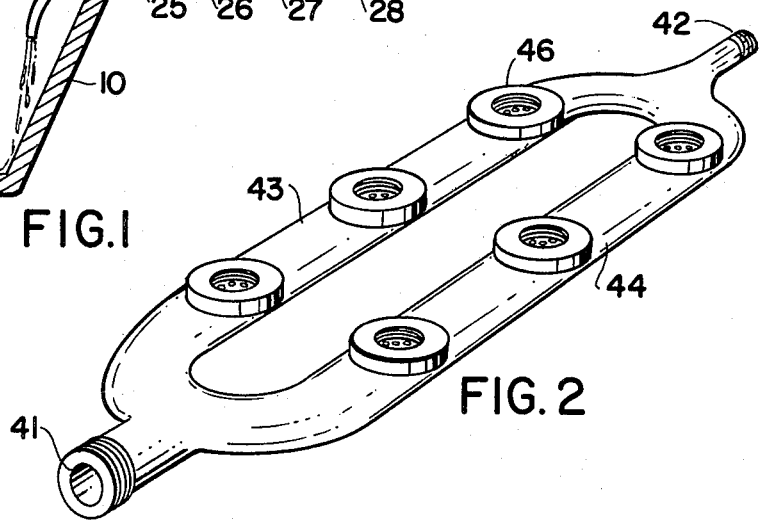
FIG. 2 is a perspective view of an alternate embodiment of such apparatus.

Referring to FIG. 2, there is shown an alternate embodiment of a dye bottle washing apparatus 40. As can be seen, the apparatus has an inlet 41 to which a source of water is applied and an outlet 42 which serves as the drain. The unit 40 has two arms 43 and 44 which consists of two separate pipes each having bottle accomodating annular members as 46 and 47 surrounding an associated group of apertures. In this manner the apparatus can consist of different branches of pipes each of which will accomodate a predetermined number of bottles. Thus the apparatus can be expanded as shown in FIG. 2 to accommodate a large number of bottles in a relatively small size.

Figure 3:
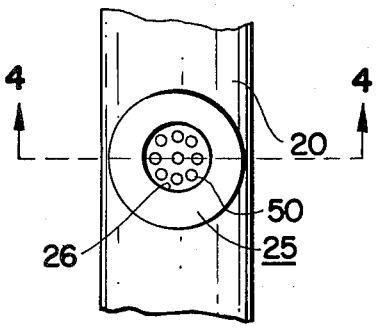
FIG. 3 is a top plan view showing an annular bottle holding member.
Figure 4:
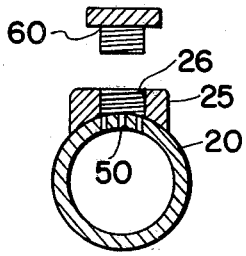
FIG. 4 is a cross-sectional view taken through line 4—4 of FIG. 3.

Referring to FIG. 3, there is shown a top view of a portion of the pipe 20 and an annular member such as 25. As shown in FIG. 2, the pipe 20 has a group of apertures 50 on the surface and is surrounded by the annular member 25 which has an internal thread 26 as shown more clearly in FIG. 4. If the number of bottles to be washed is less than the number of bottle accomodating sections, a plug as plug 60 can be screwed into the annular member 25 to prevent water from escaping through the apertures 50.

Figure 5:
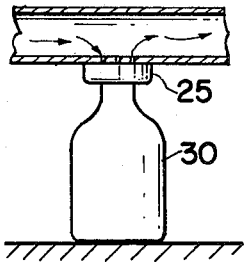
FIG. 5 is a partial sectional view showing the apparatus employed with a bottle in the non-inverted position.

As shown in FIG. 5, the entire assembly can operate in an inverted position where the bottle will be filled with water and eventually the water will overflow out of the apertures back into the pipe for an eventual discharge through the outlet opening.

Thus as can be seen, the apparatus is extremely simple and compact and can accomodate a large number of bottles in a simple manner. The annular ring section as 25 can be integrally formed with the pipe or can be glued or epoxied on to the pipe by the use of a waterproof bonding agent. The configurations depicted in the figures show circular pipes and annular rings. It is of course understood that any other goemetrical shape could be employed, as for example, pipes having square or rectangular cross-sections, as well as annular members having different surface configurations.

Figure 6:
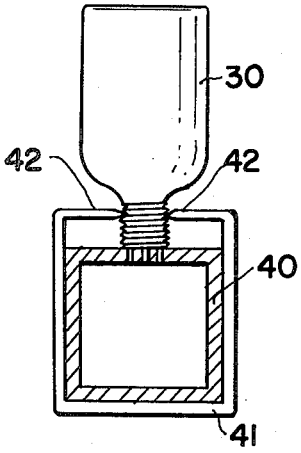
FIG. 6 is a cross-sectional view depicting the alternate embodiment according to this invention.
Figure 7:
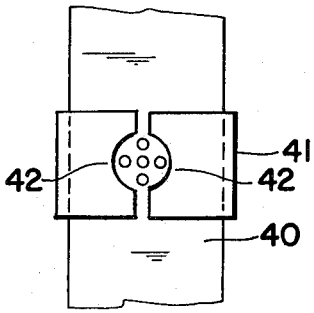
FIG. 7 is a partial top plan view of the apparatus shown in FIG. 6.

Referring to FIG. 6, there is shown a pipe 40 having a rectangular cross-section. A clip member 41 is of a U-shaped configuration and snaps over the pipe. The member 40 has two extending projections as 42 and 43. The projections may be threaded or may have tapered edges which will coact with the threads at the neck of the bottle 50. In this manner as shown in FIG. 7, the flat top of the bottle is firmly pushed or forced against the flat surface of the pipe 40. The bottle is held in place by the clip 41 as should be apparent from FIGS. 6 and 7. In the configuration shown in FIGS. 6 and 7, the coupling member 41 does not have to be integrally formed with or attached to the pipe but can be clipped over the pipe and as such is fabricated from a flexible plastic material.

It is therefore understood that many alternate constructions employing the same principles may be ascertained by one skilled in the art. It is therefore intended that all such modifications and alternate structures are deemed to be encompassed within the spirit and scope of the claims as appended hereto.

I claim:

1. Apparatus for cleaning bottles comprising:

an elongated tubular member having an inlet opening at one end adapted to be connected to a fluid source, and having outlet means for discharging fluid, said tubular member having a plurality of apertures in a surface with said apertures arranged in groups and spaced apart at predetermined intervals;

a plurality of coupling members each associated with and surrounding a separate group of apertures with an opening of each of said coupling members associated with a separate group of apertures, and means located about each opening of each coupling member for accomodating a separate bottle, whereby when each coupling member is accomodating a bottle, fluid at said inlet enters each bottle via said group of apertures to clean the same with said fluid discharged via said outlet means

2. Apparatus for cleaning bottles according to claim 1, wherein said means located about each opening of each coupling member is an internal thread selected to allow a threaded necked bottle to be screwed into position whereby the opening of said bottle communicates with said apertures, with each of said coupling members being an annualar member.

3. Apparatus for cleanin bottles according to claim 2 where said elongated tubular member has a constricted area nearest said outlet means.

4. Apparatus for cleaning bottles according to claim 3 further including coupling means coupled to said inlet opening for connecting the same to said fluid source.

5. Apparatus for cleaning bottles according to claim 4 wherein said fluid source is a water faucet.

6. Apparatus according to claim 5 wherein said group of apertures are located in a top surface of said tubular member whereby said apparatus accomodates bottles in an inverted position.

7. Apparatus according to claim 5 wherein said group of apertures are located in a bottom surface of said tubular member, whereby said apparatus accomodates bottles in a non-inverted position.

8. Apparatus according to claim 1 wherein, said coupling member is a U shaped clip adapted to encircle said tubular member and having projections from each arm overlying said group of apertures.

9. Apparatus according to claim 1 wherein said tubular member includes a first tubular section having an inlet opening with said opening in common with a second tubular section, each of said sections having groups of spaced apertures with associated coupling members for accomodating bottles at each coupling member.

10. Apparatus according to claim 1 further comprising:

stopper means adapted for insertion into any one of said central openings of said coupling members, to block fluid flow when said member is not accomodating a bottle.

* * * * *